United States Patent [19]

Landi

[11] 4,040,619

[45] Aug. 9, 1977

[54] SQUEEZE TOY AND EXERCISING DEVICE

[76] Inventor: James V. Landi, 213 Windmill St., N. Providence, R.I. 02904

[21] Appl. No.: 717,215

[22] Filed: Aug. 24, 1976

[51] Int. Cl.[2] ..... A63B 21/30

[52] U.S. Cl. ..... 272/68; 46/156

[58] Field of Search ..... 272/68, 67, 70, 76, 272/93, 122, 123, 130; 46/115, 156; 293/DIG. 2, 71 P; 5/337, 341

[56] References Cited

U.S. PATENT DOCUMENTS

| | | | |
|---|---|---|---|
| 2,714,011 | 7/1955 | Albee | 293/DIG. 2 |
| 2,817,187 | 12/1957 | Auzin | 46/156 X |
| 3,334,899 | 8/1967 | Bosko et al. | 272/122 |
| 3,601,923 | 8/1971 | Rosenberg | 46/156 |
| 3,658,326 | 4/1972 | Fawick | 272/68 |
| 3,664,653 | 5/1972 | Walker | 293/71 P |

*Primary Examiner*—Richard C. Pinkham
*Assistant Examiner*—William R. Browne
*Attorney, Agent, or Firm*—Allen D. Brufsky

[57] ABSTRACT

A flexible and resilient manually collapsible transparent hour-glass shaped housing contains a loosely held liquid-saturated sponge in each of the upper and lower chambers of the housing. One chamber is squeezed to drive liquid from the upper to the lower chamber for exercising the hand and fingers, and turned upside down to repeat the exercise. The device can be used for amusement by determining if successive participants in a contest can squeeze additional liquid from one chamber to the other.

4 Claims, 3 Drawing Figures

SQUEEZE TOY AND EXERCISING DEVICE

BACKGROUND OF THE INVENTION

This invention relates to an amusement device, and more particularly, an amusement device which can also be used to exercise the hand and fingers to increase the strength of the grip.

Besides being ideal as an exercising device, contests of strength can be played with the device of the invention.

SUMMARY OF THE INVENTION

In accordance with the invention, a flexible and resilient transparent plastic or rubber hour-glass shaped housing is provided. The top and bottom of the housing comprises a squeezable bulb containing a sponge saturated with a liquid fluid, such as water. One contestant grips the upper bulb and squeezes as hard as he can to drive fluid from the sponge through the neck of the housing to the lower chamber. The next contestant attempts to squeeze more fluid from the same sponge. If successful, he is declared the winner. If unsuccessful, the first contestant is declared the winner and a new contest initiated by turning the housing upside down. A single user can perform the same motions with the device to exercise his hand and fingers.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
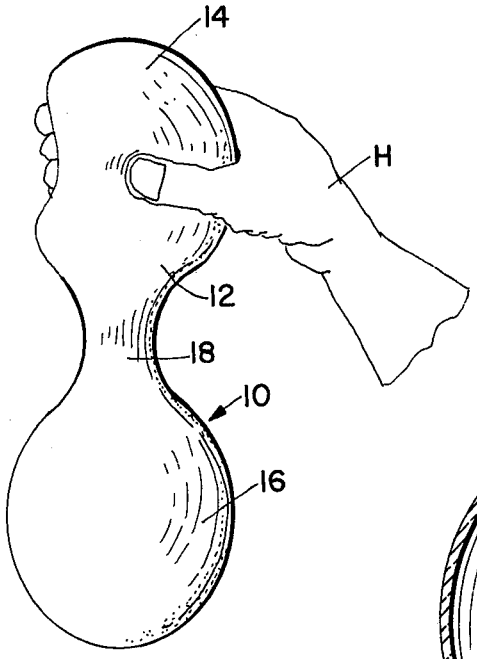
FIG. 1 is a perspective view of the squeeze toy of the present invention in use.
Figure 2:
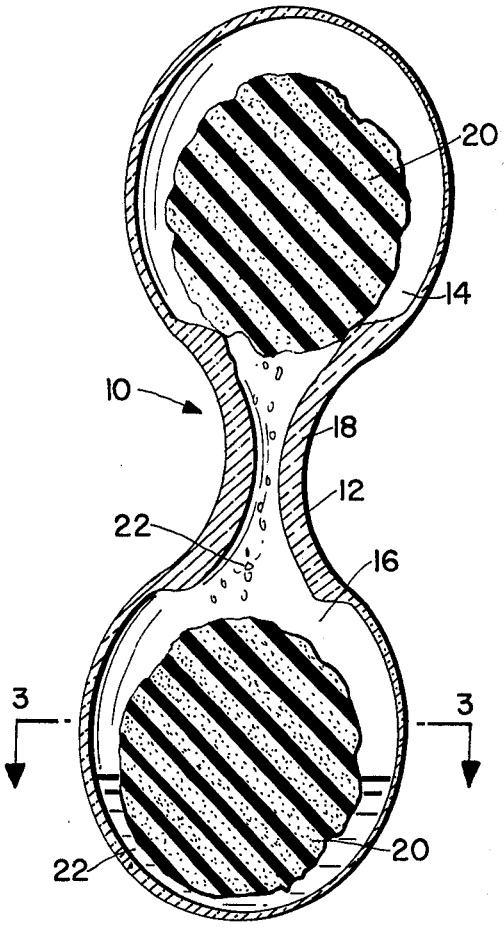
FIG. 2 is a longitudinal cross-sectional view of the squeeze toy of FIG. 1.
Figure 3:
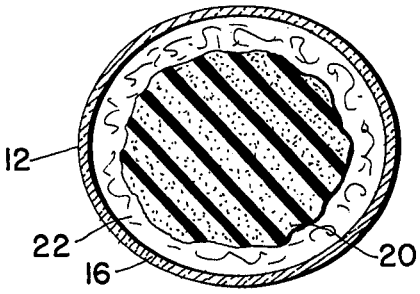
FIG. 3 is a cross-sectional view taken substantially along the plane indicated by line 3—3 of FIG. 2.

Referring now in detail to the drawing, wherein like numerals indicate like elements throughout the several views, the squeeze toy and exercising device 10 of the present invention includes a flexible and resilient transparent plastic or rubber housing 12 in the shape of an hour-glass having an upper and lower flexible bulbous portion 14 and 16, respectively, connected by a constricted neck 18.

Each bulb portion 14, 16 contains a sponge 20 saturated with a liquid, such as water. In use as an exercising device, the housing 12 is held upright and the upper bulb 14 squeezed by the hand H and fingers as hard as possible to drive liquid 22 from upper sponge 20 through neck 18 to the lower bulbous portion 16 saturating lower sponge 20. The housing is then turned upside down and the foregoing action repeated.

In use as an amusement device, one contestant grips upper bulb 14 and squeezes as hard as he can to drive fluid 22 from upper sponge 20 to lower bulb 16 through neck 18. The next contestant attempts to squeeze more fluid 22 from the same sponge. Because of the transparent nature of housing 12, success can be visually observed. If successful, he is declared the winner. If unsuccessful, the first contestant is declared winner and a new contest initiated by turning housing 12 upside down.

I claim:

1. An amusement and exercising device comprising:

a flexible and resilient housing means which is manually collapsible for exerting a force on a liquid saturated sponge for forcing the liquid therein from an upper and to a lower portion, said housing means including upper and lower portions, said portions being connected by a constricted neck portion, and a liquid-saturated sponge loosely held within each of said portions.

2. The device of claim 1 wherein said housing is formed from transparent material.

3. The device of claim 1 wherein said housing means has an hour-glass shape forming upper and lower bulbous portions, and said sponge is contained within each of said bulbous portions.

4. The device of claim 3 wherein said neck portion is contricted and provides a continuous passageway from said upper to said lower bulbous portion of said housing means.

* * * * *